United States Patent [19]

Hughes, Sr.

[11] Patent Number: 4,862,994

[45] Date of Patent: Sep. 5, 1989

[54] LADDER PLATFORM

[76] Inventor: Earl E. Hughes, Sr., 3 Hughes Cir., Glen Burnie, Md. 21061

[21] Appl. No.: 211,224

[22] Filed: Jun. 22, 1988

[51] Int. Cl.[4] ..... E06C 7/14

[52] U.S. Cl. ..... 182/122; 182/129; 182/214; 248/238

[58] Field of Search ..... 184/214, 121, 93, 107, 184/129, 122; 248/238

[56] References Cited

U.S. PATENT DOCUMENTS

| | | | |
|---|---|---|---|
| 1,004,284 | 9/1911 | Lehmann | 182/121 |
| 2,803,389 | 8/1957 | Munson | 182/214 |
| 2,908,345 | 10/1959 | Lund | 182/214 |
| 2,999,290 | 9/1961 | Giles | 182/107 |
| 3,100,026 | 8/1963 | Sunshine | 182/214 |
| 3,734,236 | 5/1973 | Houtler | 182/214 |
| 4,261,435 | 4/1981 | Winter | 182/121 |
| 4,401,187 | 8/1983 | Van Patten | 182/214 |
| 4,598,795 | 7/1986 | Larson | 182/214 |

FOREIGN PATENT DOCUMENTS

| | | | |
|---|---|---|---|
| 1082149 | 7/1980 | Canada | 182/214 |

*Primary Examiner*—Reinaldo P. Machado
*Attorney, Agent, or Firm*—Leon Gilden

[57] ABSTRACT

A selectively removable support platform is designed to be attached to the rungs of a conventional ladder. The platform includes pivotally interconnected arms which may be aligned with the hollow metallic rungs of the ladder, and connector pins pivotally attached to the arms may then be projected through apertures in the arms so as to be positioned within the rung interiors. Safety straps may then be used to lock the connectors in position, and platform alignment is facilitated through the use of a telescoping adjustable arm construction. Short safety chains may optionally be provided for connecting the platform to a gutter spout or some other building structure, and the front of the platform is covered with a rubber or foamed plastic material so as to prevent both slippage and damage to the structure against which the platform is resting. Additionally, the foam or rubber material provides an electrically insulative effect between the ladder platform and metal siding.

14 Claims, 3 Drawing Sheets

LADDER PLATFORM

BACKGROUND OF THE INVENTION

1. Field of the Invention

The present invention relates to ladder platforms, and more particularly pertains to a new and improved ladder platform which may be quickly and easily attached to and removed from a conventional ladder.

2. Description of the Prior Art

Ladder platforms heretofore devised and utilized for the purpose of providing stabilized work platforms on the top of ladders are known to consist basically of familiar, expected and obvious structural configurations. In this regard, a myriad of designs encompassed by the crowded prior art and have been developed for the fulfillment of countless objectives and requirements. However, the ladder platform according to the present invention substantially departs from the conventional concepts and designs of the prior art, and in so doing provides an apparatus primarily developed to facilitate ease of installation and removal while also substantially reducing the complexities and cost of manufacture.

More particularly, a number of patents have issued directed to the construction of ladder platforms. As can be determined however, these prior art ladder platforms represent structures which are difficult and expensive to manufacture. Accordingly, little or no commercial success has been achieved as evidenced by their lack of availability to the consuming public. In this connection, several prior art configurations have been directed to the permanent installation of ladder platforms to their associated ladders. Examples of these permanently attached platforms are to be found in U.S. Pat. Nos. 2,749,008 which issued to H. Wilson on June 5, 1956; 3,057,431 which issued to J. George on October 9, 1962; and 4,530,419 which issued to Rumage et al on July 23, 1985. As can be appreciated, the use of a permanently attached platform substantially increases the handling weight of a ladder and in many instances, ladder platforms are not always required or are even undesirable for a particular job. As such, the increased difficulty of utilizing a ladder with a permanently attached platform may have resulted in the above-mentioned lack of commercial success of these types of devices.

One example of a selectively removable ladder platform is to be found in U.S. Pat. No. 2,881,028 which issued to J. Baird on April 7, 1959. The Baird platform is functional for its intended purpose, i.e., being easily attached to and removed from a conventional ladder. However, the Baird platform is of a large and bulky construction and includes support railings as well as a platform of a size designed to allow a workman to stand thereon. Further, the large number of specially designed components would undoubtedly result in a high manufacturing cost so as to provide serious limitations to any commercial venture attempting to sell and market this type of device.

At least one ladder platform has been developed which is of a simplistic and lightweight construction. In this respect, reference is made to U.S. Pat. No. 4,159,045 which issued to R. Brooks on June 26, 1979. The Brooks patent discloses a ladder platform having a flat table portion for supporting tools and other equipment, and a pair of rectangularly-shaped tubular members are fixed to rear outside corners of the table for slidably mounting the platform over the upper ends of the rails of a straight ladder. While also being functional for its intended purpose, it can be appreciated that modern metallic ladders typically have their rungs mounted quite close to the ends of the ladders which would thus prevent the use of this type of ladder platform attachment. More specifically, the free ends of the ladder are too short to facilitate a slidable positioning of the tubular members thereover. Further, the Brooks ladder platform is designed to be rigidly attached to the tubular members which thus limits the user's ability to adjust the horizontal positioning of the platform. In other words, the end of the ladder would always have to be positioned at the same angle with respect to the structure against which it is resting if the platform were to be maintained in a perfectly horizontal plane. However, in the case of extensible ladders, this is not always possible to accomplish since it is necessary to move the base of the ladder further from the structure as the length of the ladder is increased.

Therefore, it can be appreciated that there exists a continuing need for new and improved ladder platforms which could be efficiently and inexpensively manufactured while also being capable of being easily attached to and removed from a ladder. In this respect, the present invention substantially fulfills this need.

SUMMARY OF THE INVENTION

In view of the foregoing disadvantages inherent in the known types of ladder platforms now present in the prior art, the present invention provides an improved ladder platform construction wherein the same can be easily attached to and removed from any ladder having hollow rungs or being formed from a material through which connection apertures could be drilled. As such, the general purpose of the present invention, which will be described subsequently in greater detail, is to provide a new and improved ladder platform which has all the advantages of the prior art ladder platform and none of the disadvantages.

To attain this, the present invention comprises a ladder platform that is of a lightweight and inexpensive construction which can be easily attached to or removed from any type of standard open rung extension ladder now available in the commercial market. The platform includes pivotally interconnected arms which may be aligned with the hollow metallic rungs of the ladder, and connector pins pivotally attached to the arms may then be projected through apertures in the arms so as to be positioned within the rung interiors. Safety straps or pintles may then be used to lock the connectors into position, and platform alignment in facilitated through the use of a telescoping adjustable arm construction. Short safety chains may be provided for connecting the platform to a gutter spout or some other building structure, and the front of the platform is covered with a rubber or foamed plastic material so as to prevent damage to the structure against which the platform is resting. Additionally, the foam or rubber material provides an electrically insulative effect between the ladder platform and metal siding.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arragements of the components set forth in the following description or illustrated in the drawings. The invention is capable of other embodiments and of being practiced and carried out it various ways.

Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved ladder platform which has all the advantages of the prior art ladder platforms and none of the disadvantages.

It is another object of the present invention to provide a new and improved ladder platform which may be easily and efficiently manufactured and marketed.

It is a further object of the present invention to provide a new and improved ladder platform which is of a durable and reliable construction.

An even further object of the present invention is to provide a new and improved ladder platform which is susceptible of a low cost of manufacture with regard to both materials and labor, and which accordingly is then susceptible of low prices of sale to the consuming public, thereby making such ladder platforms economically available to the buying public.

Still yet another object of the present invention is to provide a new and improved ladder platform which provides in the apparatuses and methods of the prior art some of the advantages thereof, while simultaneously overcoming some of the disadvantages normally associated therewith.

Still another object of the present invention is to provide a new and improved ladder platform which can be efficiently and quickly attached to and removed from any type of commercially available ladder.

Yet another object of the present invention is to provide a new and improved ladder platform which includes the use of safety connectors for attaching the platform to the ladder and the structure against which the ladder is positioned.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
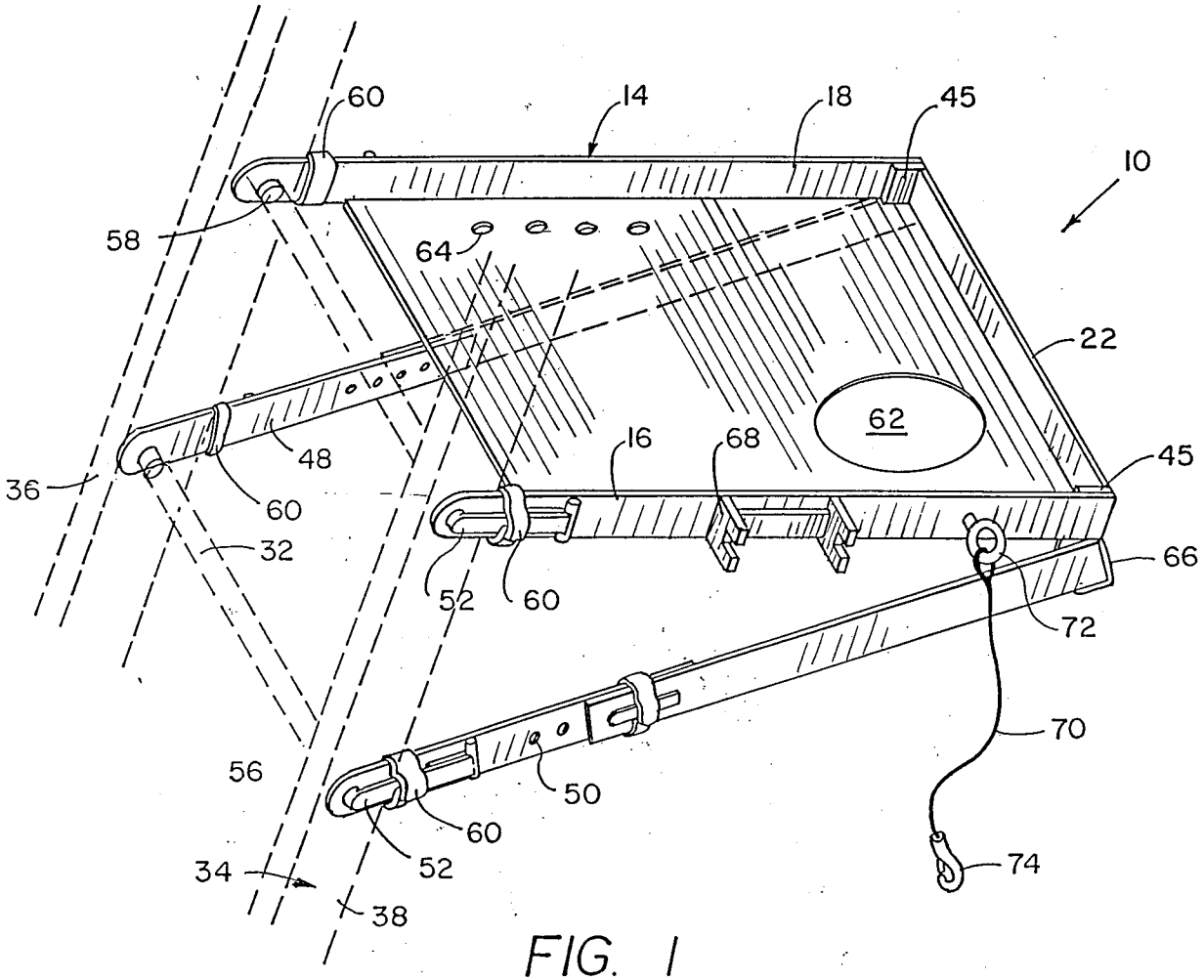
FIG. 1 is a perspective view of the ladder platform comprising the present invention wherein the same is operably attached to a conventional ladder.
Figure 2:
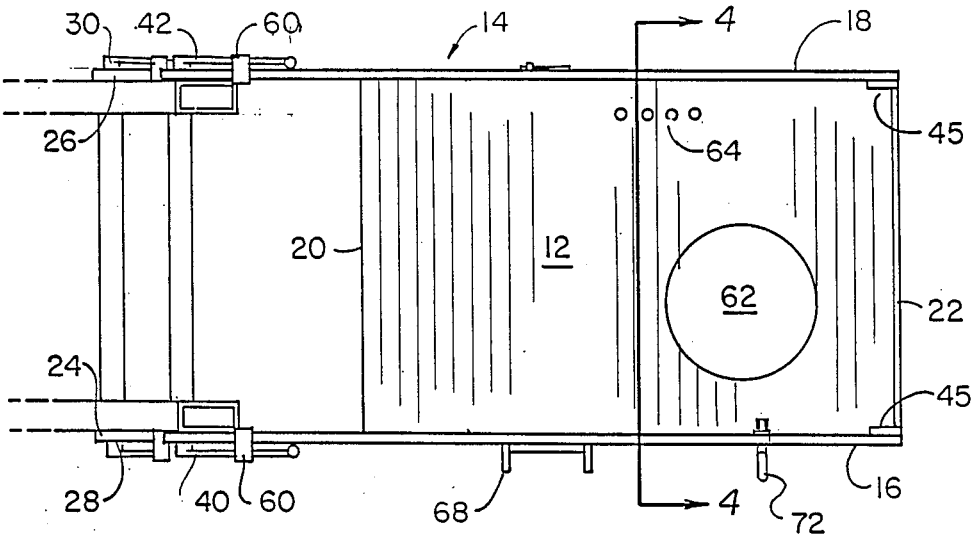
FIG. 2 is a top plan view of the platform.

With reference now to the drawings, and in particular to FIGS. 1, 2, 3 and 4 thereof, a first embodiment of a new and improved ladder platform embodying the principles and concepts of the present invention and generally designated by the reference numeral 10 will be described.

Figure 4:
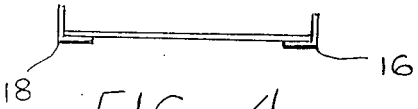
FIG. 4 is a cross-sectional view of the invention taken along the line 4—4 in FIG. 2.

More specifically, it will be noted that the first embodiment 10 of the invention essentially includes a topmost work support platform 12 fixedly positioned in a rectangularly shaped support member structure 14. The support member structure 14 includes a pair of paralleledly aligned rigid support members 16, 18 which are connected together by a pair of cross-extending paralleledly aligned support members 20, 22. In the preferred embodiment, the support members 16, 18, 20, 22 would be formed from lightweight aluminum angle stock as best illustrated in FIG. 4. As shown, the inwardly extending portions of the angles 16, 18 can be used to support the work platform 12 while the upwardly extending sides of the angles serve to define a ledge which prevents tools or other work materials from rolling off the platform. If desired, the platform 12 can be fixedly secured to one or more of the support angles 16, 18, 20, 22, or a removable positioning of the platform is within the intent and purview of the invention whereby the platform could be replaced when necessary. While the use of lightweight aluminum stock is preferred in the construction of the invention, it is to be understood that any rigid lightweight material could be used to build the components of the platform—provided that the materials possess sufficient strength to prevent platform collapse under stressful load conditions.

As further illustrated in the drawings, it will be noted that the support members 16, 18 include respective outwardly extending ends 24, 26. The extended ends 24, 26 have respective through-extending apertures 28, 30 which are alignable with the opposed ends of a ladder rung 32 in the manner best illustrated in FIG. 1. In this regard, standard open rung extension ladders 34 are formed from a plurality of such rungs 32 which are fixedly secured between a pair of paralleledly aligned support members 36, 38. The hollow rungs 32 typically extend through apertures in the support members 36, 38 so that the hollow interiors thereof may be viewed and accessed by a user. Accordingly, the apertures 28, 30 located on the respective support member ends 24, 26 may be aligned with the opposed ends of a particular rung 32, and L-shaped stainless steel pins 40, 42 may then be inserted through the respective apertures 28, 30 so as to extend into the opposed ends of the rung. This results in a pivotal attachment of the support structure 14 to the ladder 34 in a manner which will be more particularly described below.

With respect to the construction of the attachment pins 40, 42, it will be noted that such pins are pivotally attached by some conventional means to side portions of the respective support members 16, 18. As best shown in FIG. 1, hook and loop fastening strips 44, such as Velcro or the like, may be permanently attached to the support members 16, 18 and may be engagably positioned over the attachment pins 40, 42 when the ends thereof have been directed through the respective apertures 28, 30. As such, when the attachment pins 40, 42 are so positioned, the Velcro fasteners 44 prevent an undesired disengagement of the attachment pins 40, 42 from the ends of a ladder rung 32. In effect then, the attachment pins 40, 42 serve as a first locking means for securing the ladder platform support structure 14 to a chosen ladder rung 32. The Velcro straps 44 thus operate as a safety means for retaining the locking pins 40, 42 in fixed engagement with a ladder 34.

Figure 3:
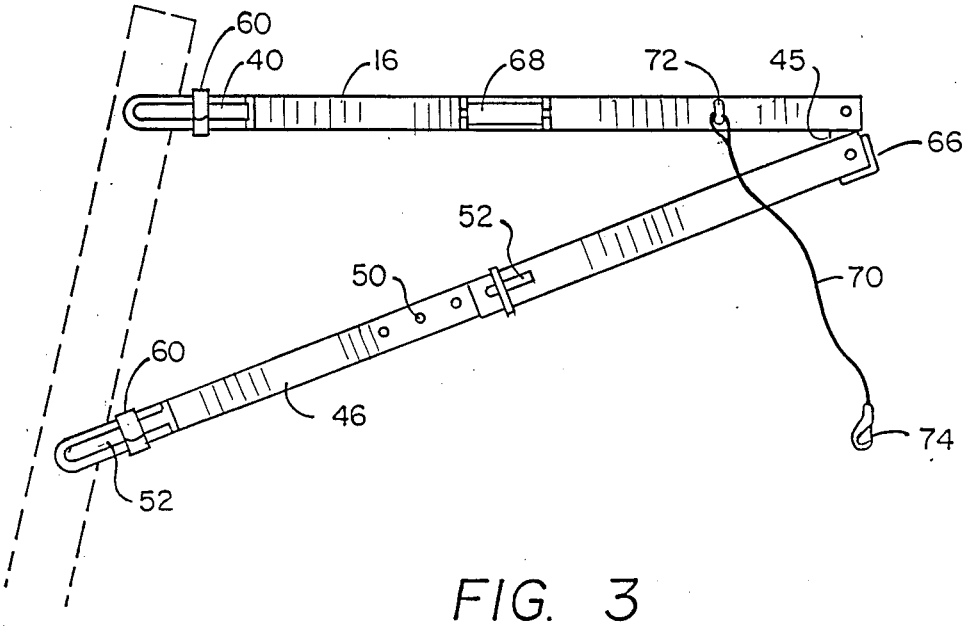
FIG. 3 is a side elevation view of the platform.

As clearly illustrated in FIGS. 1 and 3, a pair of further rigid support members 45 (only one of which is illustrated in the drawings) may be attached to the respective support members 16, 18 and extend downwardly therefrom. Pivotally attached in a conventional manner to the downwardly extending supports 45 are a pair of further telescopingly adjustable support members 46, 48. Unillustrated spring-loaded pins are designed to project outwardly through aligned apertures 50 to thus obtain the desired lengthwise adjustment of the arms 46, 48 in a conventional and well known manner. Such lengthwise adjustment of the arms 46, 48 permits the horizontal positioning of the work platform 12 with respect to the angle of inclination of the ladder in a manner which will be subsequently described in greater detail.

The telescopingly adjustable support members 46, 48 include similar respective L-shaped locking pins 52, 54 which are respectively aligned with and positionable through apertures 56, 58 located in the ends of the lengthwise adjustable support members. Further Velcro safety straps 60 may then be used to hold the locking pins 52, 54 in fixed engagement with a hollow ladder rung 32 in a now understood manner.

Other features of the first embodiment 10 of the invention include a plurality of differently sized through-extending openings 62, 64 located in the work surface 12. Tools, paint buckets, etc. may be positioned within these openings 62, 64 and, if desired, the openings could effectively be designed as recesses having bottom support floors so as to more effectively support paint buckets and the like. More specifically, bucket receiving recesses 62 would prevent the inadvertent spilling of paint as would be occasioned by a paint bucket being knocked over. Additionally, the forward support member 22 would desirably be covered with a resilient material 66 such as rubber, foam back carpeting, or the like. Such resilient material 66 would prevent damage to the siding of a house, would also serve as a friction gripping means to prevent the platform from slipping along a building, and would further serve as an insulation means against electrical shock. In this connection, metal siding buildings are sometimes struck by lightning and a lightning strike could flow through a metal ladder so as to injure a worker if some form of insulation is not used between the ladder and the building.

Further features may also include friction gripping snap hooks 68 mounted to a side of the support member structure 14. These hooks are designed to fictionally grip and hold an electrical extension cord in position relative to the platform structure 14, whereby electrical power may be available to accommodate the needs of a user. An additional safety feature includes a small length of plastic coated cable 70 or some other flexible cord material, and this cable has one end 72 attached to the support member structure 14. A spring-loaded clamp 74 is attached to the remaining free end of the cable 70, and this clamp may be selectively attached to gutter spouting or some similar available fixed structure associated with a building. The cable assembly 70 further assists in holding a ladder 34 in position against a building in case of slippage. More particularly, if the ladder 34 were to begin to slip sideways, sufficient support would be provided by the attached cable assembly 70 to prevent further slippage until a worker could dismount the ladder.

Figure 5:
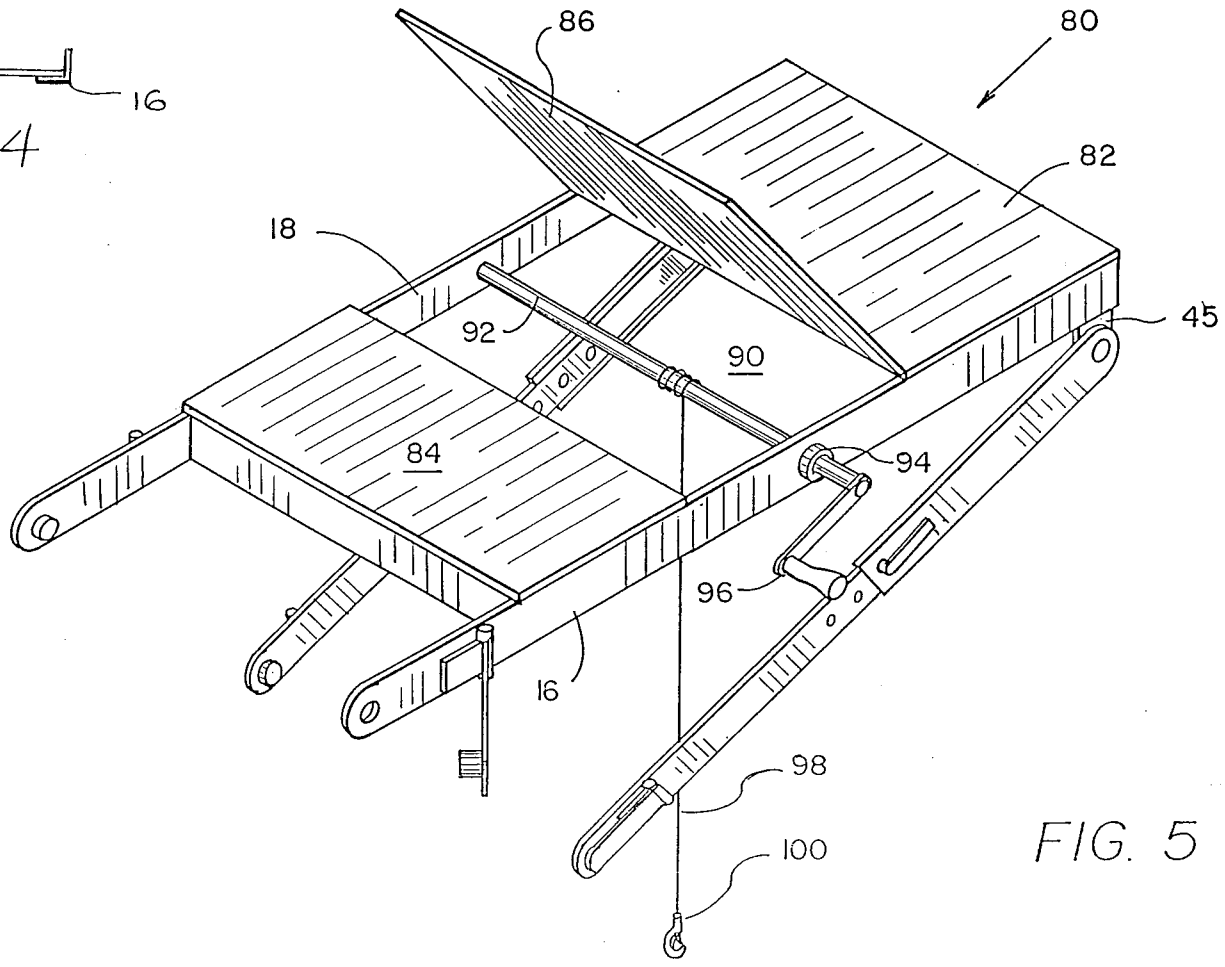
FIG. 5 is a perspective view of a modified form of the invention which includes the work hoisting means.

FIG. 5 of the drawings illustrates a modified embodiment of the invention which is generally designated by the reference numeral 80. In this regard, the embodiment 80 may include all of the components illustrated in the embodiment 10 of the invention; however, a modified work platform 82 is used in place of the platform 12 shown in the first embodiment. The modified platform 82 includes first, second and third sections 84, 86, 88 which are positionable within the frame structure 14. As illustrated, section 86 may be disconnected from section 84 while being pivotally attached to the planar section 88. As such, the section 86 may be folded upwardly so as to expose a intermediately positioned opening 90. A rotatable rod 92 is interconnected between the support arms 16, 18 with one end of the rod being positioned in a conventional reversible ratchet mechanism 94 mounted exteriorly of the support member 16. An L-shaped handle 96 may be removably positioned over an outwardly extending end of the rotatable rod 92, and the rod may then be used to wind a cord 98 which is fixedly secured thereto. A hook member 100 attached to a free end of the cord 98 can be attached to buckets of tools, paint, or the like, and a worker may then wind the cord 98 around the rod 92 so as to lift the work materials upwardly to the platform 80. Once the lifted bucket or the like is positioned upon one of the work surfaces 84, 88, the platform section 86 may be pivoted downwardly into position so as to cover the opening 90. When the worker has completed his job, the tools may be reattached to the hook 100, and the ratchet mechanism 94 may be reversed so as to permit a lowering thereof to the ground surface before the worker dismounts the ladder 34.

With respect to the manner of usage and operation of the present invention, the same should be apparent from the above description. Accordingly, no further discussion relative to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved ladder platform for attachment to a conventional ladder, said ladder platform comprising:

work surface means;

work surface support means for operably supporting said work surface means;

first connection means forming a part of said work surface support means, said first connection means being operably attachable to said ladder proximate a first rung thereof;

second connection means forming a part of said work surface support means, said second connection means being operably attachable to said ladder proximate a second rung thereof, said second connection means being pivotally attached to said work surface support means;

first locking means for operably attaching said first connection means to said ladder, said first locking means comprising at least one L-shaped pin pivotally connected to said first connection means;

and second locking means for operably attaching said second connection means to said ladder, said second locking means comprising at least one L-shaped pin pivotally attached to said second connection means.

2. The new and improved ladder platform for attachment to a conventional ladder as described in claim 1, wherein each of said L-shaped locking pins are pivotally movable through apertures located in said first and second connection means, said apertures being alignable with hollow ends of said first and second ladder rungs, said locking pins serving as a support means for said ladder platform when said platform is attached to said ladder.

3. The new and improved ladder platform for attachment to a conventional ladder as described in claim 2, and further including first and second safety locking means respectively associated with said first and second locking pins, said first and second safety locking means serving to hold said first and second locking pins in position within said hollow interiors of said first and second rungs, thereby to prevent an unintentional disengagement of said locking pins from said rungs.

4. The new and improved ladder platform for attachment to a conventional ladder as described in claim 3, wherein said first and second safety locking means comprise hook and loop fasteners positionable over said locking pins when said locking pins are positioned within said hollow interiors of said rungs.

5. The new and improved ladder platform for attachment to a conventional ladder as described in claim 4, and including further safety means for attaching said ladder platform to a structure, said further safety means comprising a safety cable interconnectible between said work surface support means and said structure.

6. The new and improved ladder platform for attachment to a conventional ladder as described in claim 4, and further including electrical extension cord support means.

7. The new and improved ladder platform for attachment to a conventional ladder as described in claim 4, and further including at least one recess formed in said work surface means, said at least one recess serving as a tool retention means.

8. The new and improved ladder platform for attachment to a conventional ladder as described in claim 4, and further including ledge means positioned around said work surface means, said ledge means serving to prevent tools and other items from rolling off of said work surface means.

9. The new and improved ladder platform for attachment to a conventional ladder as described in claim 8, wherein said ledge means is integrally a part of said work surface support means.

10. The new and improved ladder platform for attachment to a conventional ladder as described in claim 4, and further including work hoist means operably attached to said work surface support means.

11. The new and improved ladder platform for attachment to a conventional ladder as described in claim 10, wherein said work hoist means includes a rotatable reel assembly mounted to said work surface support means.

12. The new and improved ladder platform for attachment to a conventional ladder as described in claim 11, wherein said reel assembly includes a reversible ratchet mechanism.

13. The new and improved ladder platform for attachment to a conventional ladder as described in claim 12, wherein said reel assembly includes a removable crank handle.

14. The new and improved ladder platform for attachment to a conventional ladder as described in claim 10, wherein said work surface means includes a hinged section which may be opened to gain access to said work hoist means.

* * * * *